US006076938A

United States Patent [19]

Kinderman

[11] Patent Number: 6,076,938

[45] Date of Patent: Jun. 20, 2000

[54] HINGED HANGING SIMULATED ICICLE FRAME

[76] Inventor: Abraham Sandford Kinderman, 1233 Rock Creek Rd., Gladwyne, Pa. 19035

[21] Appl. No.: 09/017,104

[22] Filed: Jan. 31, 1998

[51] Int. Cl.[7] ..... F21V 21/00

[52] U.S. Cl. ..... 362/249; 362/151; 362/152

[58] Field of Search ..... 362/151, 152, 362/249, 252, 806

[56] References Cited

U.S. PATENT DOCUMENTS

| | | |
|---|---|---|
| D. 159,261 | 7/1950 | Fiechter . |
| D. 209,517 | 12/1967 | Burnbaum . |
| D. 275,917 | 10/1984 | Einhorn . |
| D. 282,801 | 3/1986 | Goins et al. . |
| D. 287,769 | 1/1987 | Davis . |
| D. 301,012 | 5/1989 | Possemato . |
| D. 305,299 | 1/1990 | Freeman . |
| D. 310,018 | 8/1990 | Landrum . |
| D. 318,608 | 7/1991 | Schenker . |
| D. 322,361 | 12/1991 | Goodman et al. . |
| D. 331,360 | 12/1992 | Adams . |
| D. 342,889 | 1/1994 | Adams . |
| D. 351,915 | 10/1994 | Hermanson . |
| D. 356,246 | 3/1995 | Adams . |
| D. 356,494 | 3/1995 | Anscher . |
| D. 358,673 | 5/1995 | Thompson . |
| D. 360,701 | 7/1995 | Glasstetter . |
| D. 383,226 | 9/1997 | Odierna . |
| D. 386,445 | 11/1997 | Odierna . |
| 767,589 | 8/1904 | Moore . |
| 1,025,964 | 5/1912 | Costuma . |
| 1,474,660 | 11/1923 | White . |
| 1,501,807 | 7/1924 | Petschel . |
| 2,346,276 | 4/1944 | Reittinger . |
| 2,447,128 | 8/1948 | Logan . |
| 2,488,326 | 11/1949 | Pratt . |
| 2,565,719 | 8/1951 | Church . |
| 2,606,734 | 8/1952 | Magnuson . |
| 2,631,803 | 3/1953 | Meyers . |
| 2,738,188 | 3/1956 | Hoffman . |
| 2,743,023 | 4/1956 | Larson . |
| 2,954,954 | 10/1960 | Larson . |
| 3,112,911 | 12/1963 | Cornwell . |
| 3,181,827 | 5/1965 | Sassin . |
| 3,536,287 | 10/1970 | Kramer . |
| 3,540,687 | 11/1970 | Cuva . |
| 3,578,282 | 5/1971 | Olsen . |
| 3,630,475 | 12/1971 | Barry . |
| 3,704,365 | 11/1972 | Miller . |
| 3,861,632 | 1/1975 | Siilats . |
| 3,870,428 | 3/1975 | Jackson . |
| 3,891,176 | 6/1975 | Downing et al. . |

(List continued on next page.)

FOREIGN PATENT DOCUMENTS

| | | |
|---|---|---|
| 2 275 176 | 1/1976 | France . |
| 804 351 | 2/1951 | Germany . |

*Primary Examiner*—Nimeshkumar D. Patel
*Assistant Examiner*—Todd Reed Hopper
*Attorney, Agent, or Firm*—Akin, Gump, Strauss, Hauer & Feld, L.L.P.

[57] ABSTRACT

A frame is provided for supporting ornamental lights on a structure. Each frame includes a rod having at least one hoop and at least one peg from which a bar is hinged or pivotally disposed. A plurality of prongs may also be provided to retain an electrical cord with ornamental lights. The bar may also be provided with a plurality of clips to retain the ornamental lights as they are strung along the bar. A plurality of frames may be joined together via the rods to form an assembly. The size of the assembly may vary according to the sizes of the frames used and the number of frames connected. The lengths of the bars may also vary. Shingle-gutter members for attaching and suspending the frame or assembly to the structure are also provided.

18 Claims, 3 Drawing Sheets

U.S. PATENT DOCUMENTS 4,244,014 1/1981 Van Ess .
4,387,873 6/1983 Pavlo et al. .
4,815,683 3/1989 Ferrante .
4,846,430 7/1989 Ke .
4,852,832 8/1989 Delaney .
4,880,133 11/1989 Cullinane .
4,979,712 12/1990 Rios .
5,057,976 10/1991 DuMong .
5,141,192 8/1992 Adams .
5,150,964 9/1992 Tsui .
5,245,519 9/1993 Openiano .
5,359,502 10/1994 Cantin .
5,379,202 1/1995 Daun .
5,413,297 5/1995 Adams .
5,422,801 6/1995 Sangalli, Jr. .
5,535,971 7/1996 Adams .
5,559,681 9/1996 Duarte .
5,566,058 10/1996 Protz, Jr. .
5,594,628 1/1997 Reuter et al. .
5,607,131 3/1997 Adams .
5,609,131 3/1997 Contigiani .
5,669,709 9/1997 Adams ..... 362/396
5,860,731 1/1999 Martinez .

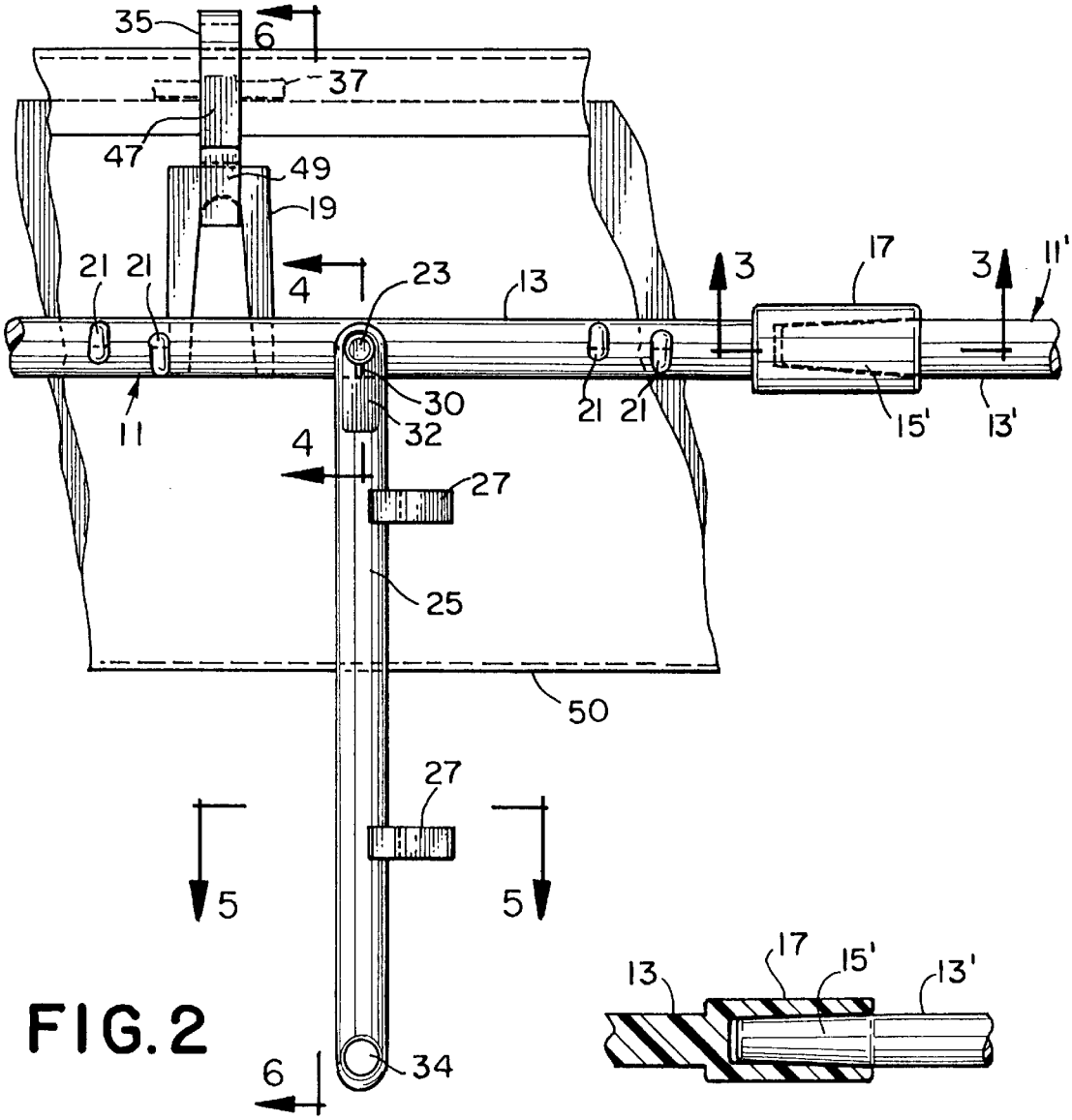
FIG. 2
FIG. 3
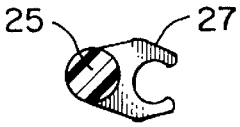
FIG. 5
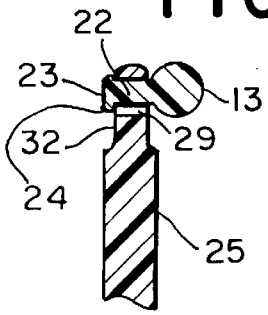
FIG. 4

HINGED HANGING SIMULATED ICICLE FRAME

BACKGROUND OF THE INVENTION

The present invention relates to a frame for supporting ornamental lights such as decorative simulated icicles that may be used during the holiday season.

Decorative lighting fixtures are becoming more sophisticated with every new holiday season. Gone are the days when simple blinking lights strung around trees would suffice to welcome Christmas and the New Year. Today there is a demand for more sophisticated lighting scenarios to adorn homes and buildings. With the demand for new lighting arrangements comes the need for newer and improved flexible frames to support these lighting arrangements and attachment devices to affix such frames to buildings and other structures.

A conventional lighting arrangement includes a cord containing a series of small light bulbs in a row which may be lengthened by plugging the cord into a subsequent cord also containing a series of small bulbs and so on until the desired length is achieved. The end cord is then plugged into an electrical outlet. Recently, frame displays have become available in which rigid frames allowing for numerous lengths of cords have been designed to allow for decorating an angled roof or a straight run of roof. Such frames are shown in Design Pat. No. 383,226 and 386,445. These new frames however do not have the flexibility and versatility to accommodate building structures that have both angled areas of different angles and straight runs in combination.

In addition to the increasing demand for more versatile lighting frames, there is a concurrent demand for improved ways and devices for attaching such frames to the building structure. Previously, numerous hooks and hangers for supporting cords and wires, particularly those with ornamental Christmas lights were available to adorn homes. Many of these hooks and hangers were permanently or semi-permanently affixed to the building structure. The installation of these devices was particularly time consuming and laborious and removal was equally complicated. In addition, these devices could not be rearranged at a later date to accommodate changes in the structure of the building or simply to rearrange for a different display of the lights.

Removable hooks such as that disclosed in U.S. Pat. No. 3,181, 827 wherein a clip designed to hold a cord with ornamental lights has an extended portion that fits between shingles and a clip portion that fits around a gutter are also commercially available. Such hooks have many advantages in that they are relatively easy to use and remove but may still be difficult to install onto gutters and other building fixtures. Other hooks that hold decorative lights are designed solely to fit between shingles such as those shown in U.S. Pat. Nos. 356,246 and 356,492, while some such as that described in U.S. Pat. No. 5,141,192 are specially designed to mount onto a gutter.

In addition, some clips are now being designed to hold ornamental lights directly to either a shingle or gutter lip. U.S. Pat. Nos. 5,669,709 relates to a decorative light holder having a base member with a first and second end in which the first end forms a hook having a spiral curvature and proximal point adjacent the base member that is adapted to be fit into a gutter and a second end that is adapted to be fit between overlapping shingles. The light holder also requires a light support that is separable from the base member and has at least one arm and an attaching member wherein the arm is configured to engage and hold a socket of a decorative light and the attaching member is adapted to secure the light support to the base member. This light holder was specifically designed to hold individual lights and prevent them from falling during inclement weather such as heavy winds.

None of the prior art permanent, semi-permanent, or removable hooks such as the ones described herein are designed to support versatile frames that hold numerous lighting arrangements. In addition, none of the clips or other suspension members now available are sufficiently versatile to suspend such elaborate ornamental works either from a shingle-edged or gutter edged roof.

There is a need for improved frames to support decorative lighting arrangements and attachment members to suspend such frames from a shingle or gutter of a building structure. In addition, there is a need for an assembly having in combination an improved frame and attachment members to be used in building structures that have both angled areas particularly where they are of varying angles and straight runs.

BRIEF SUMMARY OF THE INVENTION

A first aspect of the invention relates to a frame for supporting ornamental lights from a structure and includes a rod having an adjoining end and a hollow connecting end, at least one hoop extending from the rod and adapted to suspend the frame from a structure, at least one peg projecting from the rod and a bar pivotally disposed on the peg.

A second aspect of the invention relates to a frame assembly for suspending ornamental lights in which a plurality of flexible frames are joined together. In this embodiment, each frame includes a rod with an adjoining end and a hollow connecting end, at least one hoop extending from the rod adapted to suspend the assembly from a structure, at least one peg projecting from the rod and a bar disposed pivotally on the peg, wherein the adjoining end of one rod of one frame is disposed within the hollow connecting end of an adjacent rod of an adjacent frame to connect the frames together.

A third aspect of the invention relates to a shingle-gutter member adapted for attaching and suspending a hanging structure from a relatively fixed structure comprising at least one of shingles and a rain gutter, the member comprising (a) a tongue having a proximal end and a distal end, the tongue being adapted to be inserted beneath a shingle, (b) a spiral body having a curved portion on one side of the body to which the proximal end of the tongue is attached, the spiral body having opposed inner bearing surfaces adapted to retain the member on the gutter; and (c) an extended projection on a side of the body opposite the tongue, the projection terminating in a hook, the hook being adapted to suspend the hanging structure.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings:

FIG. 2 is an enlarged partial front elevation view of the frame of the present invention.

FIG. 3 is an enlarged cross-sectional view of the frame interconnection of two rods taken along line 3—3 of FIG. 2.

FIG. 4 is an enlarged partial cross-sectional view of the pivotal interconnection of a rod and bar taken along line 4—4 of FIG. 2.

FIG. 5 is an enlarged cross-sectional view of a bar taken along line 5—5 of FIG. 2 with a top plan view of a light socket support clip.

DETAILED DESCRIPTION OF THE INVENTION

The present invention relates to a frame for supporting ornamental lights such as decorative simulated icicles that may be used during the holiday season. Multiple frames may be joined together to form an assembly. The frame or assembly may be suspended from a building or other structure in a variety of ways with the use of a versatile hanging member that can be attached to a gutter lip or inserted between shingles on a roof. The frame includes a rod, at least one hoop for suspending the frame, and at least one peg from which a bar is pivotally disposed. Preferably the frame includes at least two pegs projected along the length of the rod and at least two bars disposed pivotally on the pegs where the bars are of two different lengths. The frame may also include a plurality of prongs spaced along the rod for holding ornamental light cords. The bars of the frame may also include a plurality of light socket support clips for holding the ornamental light sockets along the bars to simulate icicles. The frame may also be provided with a combination of prongs and light socket support clips to restrain ornamental lights that are stranded along the length of the frame. The frame may also be provided with at least one shingle-gutter member for attaching and suspending the frame to a structure wherein the member includes a tongue with proximal and distal ends, a spiral body having a curved portion on one side of the body to which the proximal end of the tongue is attached and an extended projection on an opposite side of the body wherein the projection terminates in a hook from which the frame is suspended.

Certain terminology is used in the following description for convenience only and is not limiting. The term "ornamental lights" refers to an electrical cord having a series of ornamental light bulbs with sockets attached thereto at spaced intervals. The light bulbs may be the type that illuminate continuously or the type that flicker on and off. A particularly preferred set of ornamental lights that provides an aesthetic display when used with the invention are known as Icicle Lites™ commercially available from J. Kinderman & Sons, Inc. d/b/a Brite Star Manufacturing Co. of Philadelphia, Pa., the assignee of this invention.

The terms "pivotally disposed" and "hinged" may be used interchangeably where both terms refer to the ability of a member or bar to rotate around a peg.

Figure 1:
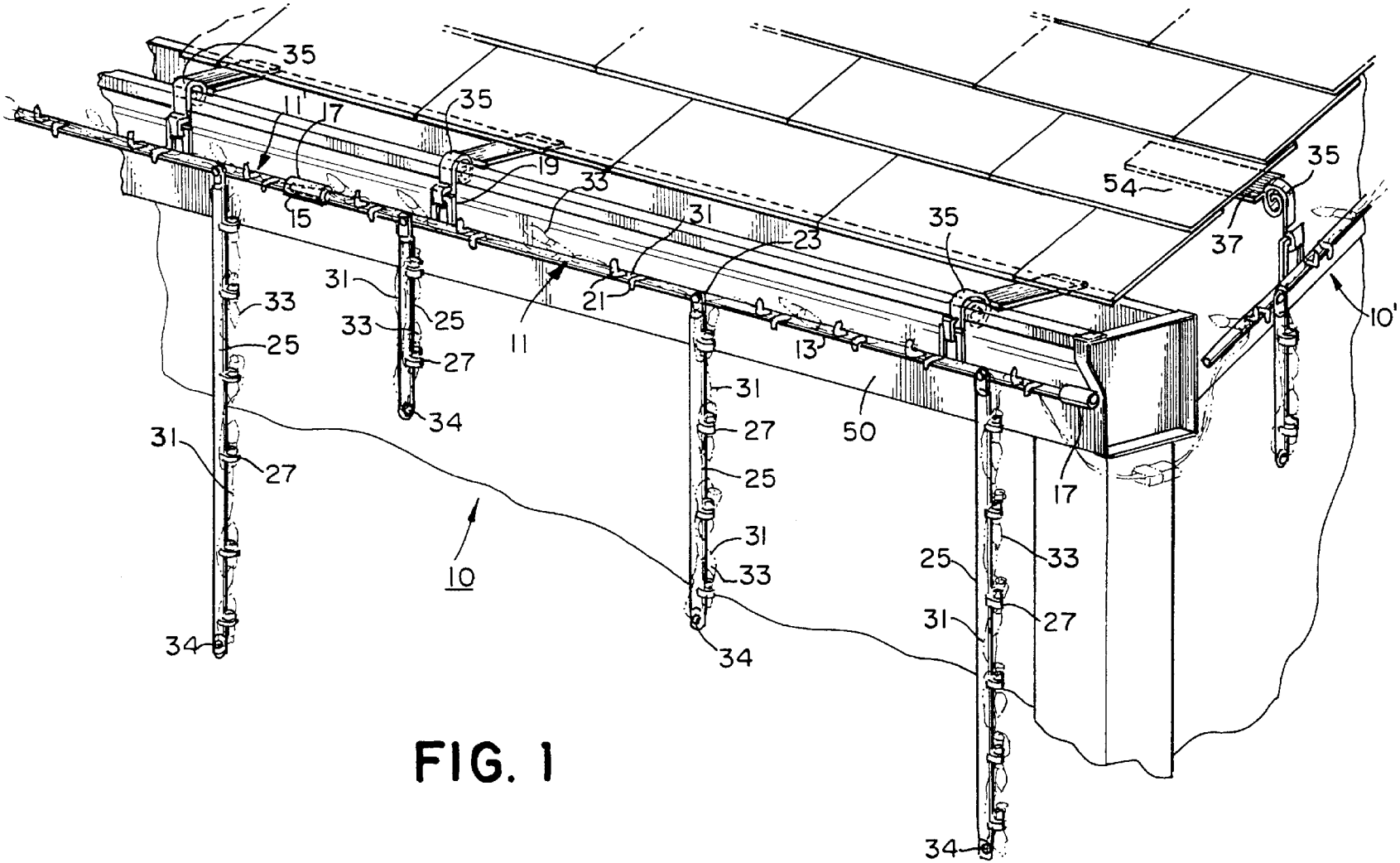
FIG. 1 is a perspective view of a portion of a frame assembly according to the present invention mounted onto a building via the shingle-gutter members, the ornamental lights and electrical cord to be supported by the frame assembly being shown in phantom.

Referring now to the drawings in detail, wherein like numerals are used to indicate like elements throughout the several views, there is shown in FIG. 1 a first frame assembly 10 which includes a first frame 11 joined to a second frame 11'. Only a partial section of second frame 11' is shown in FIG. 1, but it is to be understood that elements similar to those found on frame 11 are also present on frame 11'. The frame assembly 10 may be constructed of any length by joining one frame to another adjacent frame until the desired length is achieved. In addition, the overall assembly and components of the individual frames are flexible so that the assembly 10 can be installed easily and without interruption to buildings having a wide variety of structures including those with flat horizontal roof areas, those with gabled or angled roof areas including different angles, or those having in combination flat and angled areas. The first frame assembly 10 shown in FIG. 1 is attached horizontally to a building with a straight horizontal roof area with gutter by attaching the assembly to the gutter. A second frame assembly 10' having the elements of first frame assembly 10 is shown in FIG. 1 as being attached to the angled roof by attaching the assembly below the roof shingles.

All of the components used in the construction of the frame assembly are preferably made of polypropylene or polycarbonate, but could be made of any other material capable of suspending and attaching the frame to a building or other structure in all weather conditions, including freezing winter conditions. Metal such as spring steel or other plastics could also be used if desired. Plastics are preferred, since they can be readily extruded to form the various components and because of their durability.

Referring to FIGS. 1 and 3, each frame 11 of an assembly 10 is provided with a rod 13 having an adjoining end 15 and a hollow connecting end 17. Hollow connecting end 17 has a channel with a hollow interior region to receive an adjoining end 15 of another rod. Referring to FIGS. 2 and 3, one frame is connected to a second frame to form an assembly by the insertion of adjoining end 15' of rod 13' into the interior region of the hollow connecting end 17 of rod 13 of the adjacent frame.

Figure 6:
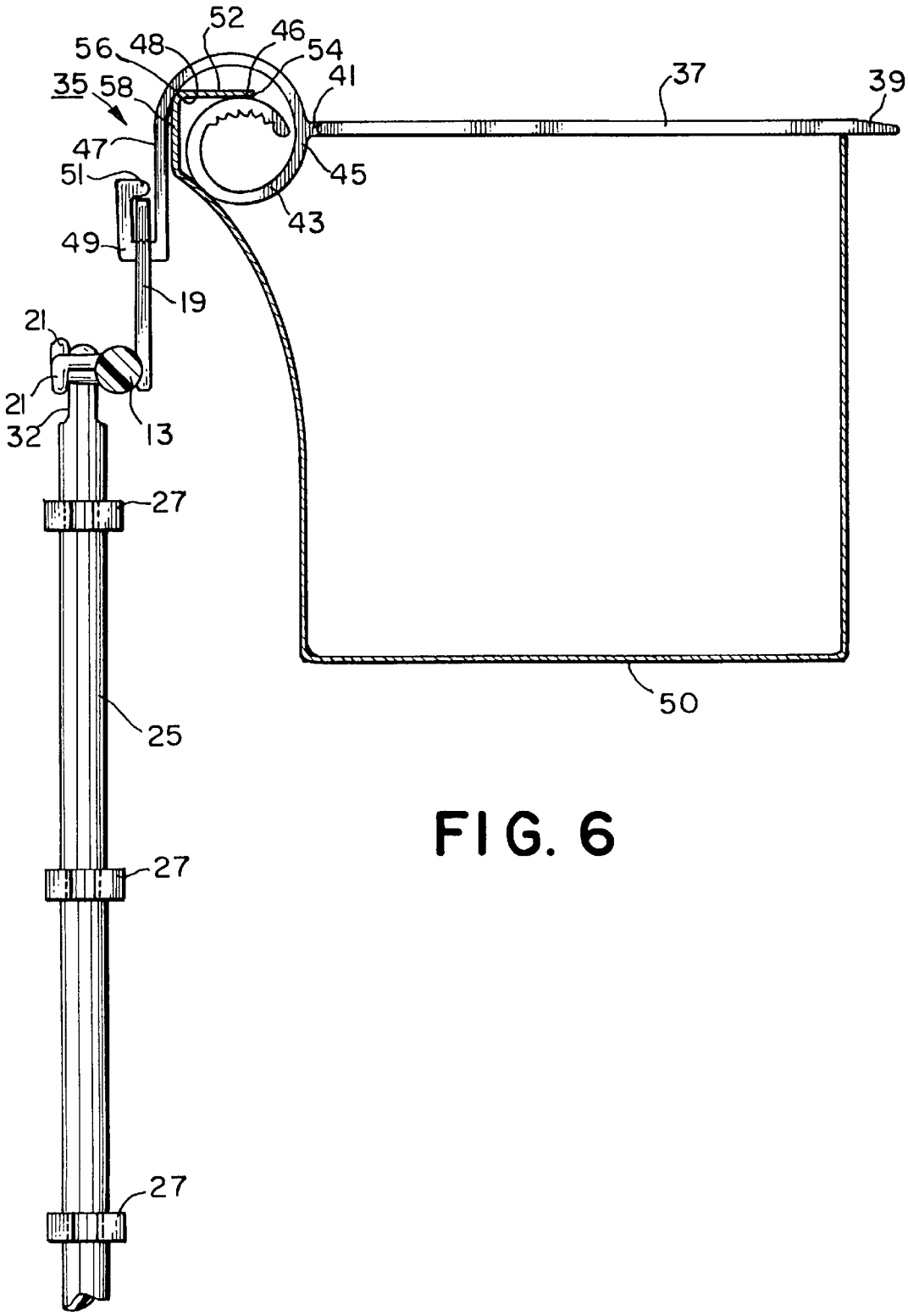
FIG. 6 is an enlarged side elevation view of the assembly including a bar and shingle-gutter member and a partial cross-sectional view of the rod, taken along line 6—6 of FIG. 2.

Referring again to FIG. 2, at least one hoop 19 is located between the two ends of the rod 13. The hoop or hoops 19 are preferably formed as a unitary structure with the rod, and are made of the same material as the rod. The hoop 19 projecting from rod 13 can also be seen in side view in FIG. 6. The hoop 19 is shown in these figures as an inverted U-shaped member in which both legs are attached to the rod so as to form an enclosed entity or loop. Alternative configurations are also suitable so long as they are at least partially closed entities to allow an attaching member to be suspended from them. As shown in FIG. 6, the hoop 19 is used with an attachment member 35 to attach and suspend the frame 11 and/or assembly 10 to the structure. Preferably, the hoop 19 is used in conjunction with shingle-gutter member 35 described in more detail below. Although FIG. 1 shows two hoops 19 connected to the rod 13 for attachment to the gutter, the number of hoops 19 connected to each rod is not a limiting factor. The number of hoops provided in fact should be sufficient to support the frame or assembly in an aesthetic manner and provide stability for the suspension between frame or assembly to the building structure.

Also projecting from rod 13 as can be seen in FIG. 2 are a plurality of prongs 21 which are positioned at spaced intervals along the rod 13 between the two ends 15 and 17. FIG. 1 shows prongs 21 in pairs and are constructed of two opposed L-shaped projections extending from the rod so that the base of the L-shape is parallel to the plane of the hoop 19. Other types and shapes of retaining prongs are also suitable so long as they can retain the ornamental lights and electrical cord along the rod 13. FIG. 1 shows in phantom a cord 31 that is wrapped around the rod 13 between a pair of prongs 21 along the length of the rod and the cord 31 for the ornamental lights 33 positioned between pairs of prongs 21 in a decorative manner as also shown in phantom. Alternatively, but not shown, the lights may be securely positioned between a pair of prongs 21. The number of prongs 21 provided along the rod 13 may vary but should be sufficient to retain any length of cord or number of ornamental lights stranded along the rod 13. Preferably, the prongs are formed as a unitary structure with the rod and made of the same material as the rod.

Referring to FIGS. 2 and 4, also projecting from the rod 13 between ends 15 and 17 are pegs 23 which are also spaced along the length of the rod. Each peg 23 has a cylindrical stem 22 projecting from the rod 13 and a slightly enlarged head 24 as can best be seen in FIG. 4. A bar 25 may be affixed to each peg 23 by inserting the peg 23 through a hole 29 disposed at the top of the bar 25. The hole 29 may be extended by an elongated slot 30 extending along the length of the bar 25. This allows the hole to expand sufficiently to accept the enlarged head 24 of the peg 23, and to contract around the stem 22 of peg 23, so that the bar is retained on the peg. To reduce the required length of the pegs 23 and to assure smooth planar surfaces in the area where the bar 25 may rub against the rod 13 and the head 24 of the peg 23, the end of the bar 25 containing hole 29 preferably has a flattened portion 32, as best shown in FIGS. 2, 4 and 6. The bar 25 remains hinged or pivotally disposed about the stem 22 of the peg 23 and the head 24 retains the bar 25 so that it does not fall off the peg 23. Again, alternate constructions of the pegs are also suitable so long as they retain the bars on the rod and allow them to pivot. The bar 25 is also provided with a second hole 34 primarily to retain the end of the electrical cord wrapped around the bar. FIG. 1 also shows a rod 13 having three pegs 23; however, the number of pegs on a rod 13 may be more or less than that shown and the number of pegs actually used in application may vary. As with the hoop 19 and prongs 21, the pegs 23 are preferably molded with the rod to form a unitary structure. The rod 13, hoop 19, prongs 21 and pegs 23 are all preferably made of the same material and constructed as a unitary structure by injection molding or other similar process.

Each bar 25 is pivotally disposed or hinged about a peg 23 such that it has a wide range of motion around the peg. Preferably the range of motion should be at least 90° and up to almost 180° about the peg and the bar 25 may be able to pivot up to 360° about the peg provided the bar can be slightly bent to avoid disturbance with the prongs. The pivoting ability of the rod about the peg is important when the frame or assembly is suspended from the building or other structure. If the frame or assembly is suspended from a roof edge that runs straight and parallel to the ground, the bars 25 will pivot downward from the rod 13. Likewise, if the frame or assembly is suspended from an angled region of the roof, the bars 25 will again pivot downward regardless of the position or angle of the rod 13 of the frame 11 or assembly 10. In this way, the bars supporting the simulated lighted icicles will always be vertical, just as real icicles are vertical.

In addition to the variable number of bars 25 used, the length of each bar may also vary within a frame 11. FIG. 1 shows three bars present per frame wherein each bar 25 has a different length. Non-limiting examples of lengths of bars having three different lengths are about 4.5 inches (about 11.4 cm), about 9.5 inches (about 24 cm) and about 15 inches (about 38 cm). Likewise, the length of rod 13 may be any convenient length. A non-limiting example of a length of a rod 13 used, for example with the exemplary bar lengths noted above (or with any other bar lengths) is about 24.5 inches (about 6.2 cm) measured from the end of the adjoining end 15 to the end of the hollow connecting end 17.

Each bar 25 may have a plurality of light socket support clips 27 projecting from its side between the ends of the bar. This can best be seen by referring to FIGS. 2 and 5. The clips 27 are spaced along the length of the bar 25. If desired, the bar can be made without clips and as many clips may be separately mounted on the bar as desired. It is preferred that the clips be formed with the bar as a unitary structure, using the same material as the bar, by an injection molding process or other similar process. As can be seen in FIG. 5, the clips are generally C-shaped projections that are used to retain the light sockets of the ornamental light bulbs. Other configurations can be used so long as they can securely and removably hold the sockets of the light bulbs. The number of clips may vary according to the size of the bar. Also the spacing of clips 27 along the bar may vary. In stranding the lights, the electrical cord 31 of the ornamental lights may be stranded down along the length of the bar or wrapped around the bar, and either through the hole 34 or around the bottom of the bar 25 and then stranded up along the length of the bar until it reaches the bar 13 as shown in FIG. 1.

One particularly pleasing display entails using every other or alternate light socket support clips 27 on the bar 25 to contain sockets 33 of the light bulbs on the way down and inserting the subsequent light bulb sockets 33 in the remaining clips 27 on the way back up such that an icicle impression is created. Alternate arrangements using the clips 27 are also suitable according to one's personal preferences.

A preferred member for attaching and suspending either a single frame or an entire assembly to a structure, such as a building, includes use of a shingle-gutter member 35 as best seen in FIGS. 2 and 6. The shingle-gutter member 35 is a unitary structure or one-piece unit that has a tongue 37 of extended length with a proximal end 41 and a distal end 39. The proximal end 41 is attached to a curved portion 45 of a spiral body 43. Extending from the side of the spiral body 43 that is opposite to that of the tongue is an extended vertical projection 47 disposed substantially at a right angle to the plane of the tongue 37. The extended vertical projection 47 is approximately the height of the spiral body 43 and is bent at the lower end to terminate in a hook 49. The hook 49 has an end leg portion 51 extending toward the extended vertical projection 47. Hoop 19 of the flexible frame 11 fits in the hook 49 within a space between end leg portion 51 and the extended vertical projection 47. The end leg portion 51 overlaps at least a portion of the hoop 19 so that the hoop is securely, but removably secured within the hook 49 when in use.

The spiral body 43 of the shingle-gutter member 35 includes a first curved inner bearing surface 46 and second curved inner bearing surface 48 disposed opposite to the first inner bearing surface 46. The shingle-gutter member 35 is attached to a rain gutter 50 by manipulating the spiral body 43 so that the spiral body 43, and therefore, the shingle-gutter member 35, is firmly but removably retained by the upper flange 52 of the gutter between the first and second inner bearing surfaces 46 and 48 by the spring tension inherent in the shape and in the resilient material used to make the shingle-gutter member 35. The first inner bearing surface 46 bears against the underside of inner-facing end 54 of the upper flange 52, while the second inner bearing surface 48 bears against the outer surface of the edge 56 connecting the upper flange 52 and the upper front wall portion 52 of the gutter 50. The shingle-gutter member is preferably made of polypropylene or polycarbonate, but could be made of any other material capable of suspending and attaching the frame to a building or other structure in all weather conditions, including freezing winter conditions. Other plastics or metal, such as spring steel, could also be used if desired. Plastics are preferred, since they can be readily extruded and sliced or molded to form the shingle-gutter member and because of their resilience under various weather conditions.

If the frames are to be attached between the shingles 54 or between shingles and the roof decking, rather than to a gutter, the tongue 37 of the shingle-gutter member 35 is utilized rather than the spiral body 43. Thus, the tongue 37, starting with the distal end 39, is inserted beneath a shingle, such as between two layers of overlapping shingles 54 or between the shingles 54 and the roof decking, as shown with respect to assembly 10' in FIG. 1.

Alternatively but not shown, other types of members may be employed for hanging or suspending the frame or assembly to a structure via either the gutter or shingles, or directly to the side or frame of the building or other structure. Such members include S-shaped hooks, gutter clamps, wires, cup screws, nails, screws, etc.

Thus, each frame 11 comprises a rod 13 with at least one projected hoop 19 and at least one peg 23 from which a bar 25 is pivotally attached. The rod may also be provided with a plurality of prongs 21 to retain an electrical cord with ornamental lights as it is stranded along the length of or wrapped around the rod 13. Each bar 25 may also be provided with light socket support clips 27 extending along its length that are designed to retain sockets of ornamental lights as a cord is stranded along its length. A plurality of frames 11 may be joined together to form an assembly 10 by connecting an adjoining end 15 of the rod of one frame 11 with a hollow connecting end 17 of a rod of an adjacent frame. The hoops 19 of each rod are preferably connected to a shingle-gutter member 35 which suspends the frame or assembly to the building or other structure. Both the frames and shingle-gutter members are made from all weather-proof material such as plastic that is extruded or molded in accordance with existing plastic manufacturing technology.

It is preferred that two frames be assembled at a time. As such, two rods 13 are joined by inserting an adjoining end 15 of one rod with the hollow connecting end 17 of another. The bars 25 are then snapped onto the pegs 23 of the rod. Alternatively, the bars 25 may be attached to the pegs 23 before the rods 13 are connected together. A particularly aesthetic design occurs if bars of different length per frame are used and the pattern is repeated throughout the assembly or a random arrangement is used.

The wire of the light set is extended and wrapped around the length of the rod 13. If a bulb becomes loosened during assembly, it will be readily apparent which bulb needs adjusting. The light set is wrapped over and under the pairs of prongs 21 projecting along the rod. As the light set is wrapped to the site of a peg 23 with bar 25, the light set is flexed so as to run down the bar 25 and a light bulb socket is inserted into the first clip 27 of the bar. After the bulb is inserted into the first clip, various design patterns utilizing the clips may be made. A preferred pattern includes skipping every other clip down to the bottom of the bar. The wire is then passed through the hole 34 at the bottom of the bar 25 and back up along the bar length such that remaining bulbs fill the empty clips 27 on the way back up the bar to the rod. The net effect of such a pattern is the creation of an icicle formed from lights. The remaining light set is then continued to be wrapped along the length of the rod 13 until the next bar is met where the steps to create an icicle effect are repeated.

Once the desired number of frames are prepared, the entire assembly is attached and suspended to the building or other structure, preferably using the previously described shingle-gutter members.

Alternative displays may also be produced with the use of the versatile frame/assembly. The light set may contain either steady burning or blinking bulbs or a combination of both.

The individual frames or assemblies may be used to fit and decorate any roof type or roof geometry because of the pivoting bars and the flexible features provided.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A frame for supporting ornamental lights comprising a. a rod having an adjoining end and a hollow connecting end, the rod further comprising at least one hoop extending from the rod adapted to suspend the frame from a structure and at least one peg projecting from the rod; and b. a bar disposed pivotally on the peg.

2. A frame for suspending ornamental lights according to claim 1 wherein the frame has a plurality of pegs spaced between the ends of the rod and at least two bars having at least two different lengths, each bar being disposed pivotally on a separate peg.

3. A frame for suspending ornamental lights according to claim 1 wherein the frame has a plurality of pegs spaced along the rod between the ends of the rod and at least three bars having at least three different lengths, each bar being disposed pivotally on a separate peg.

4. A frame for suspending ornamental lights according to claim 1 wherein the rod has a plurality of prongs spaced along the rod between the two ends for holding an ornamental light cord.

5. A frame for suspending ornamental lights according to claim 1 wherein the bar has a plurality of light socket support clips adapted for holding light sockets spaced along its length.

6. A frame for suspending ornamental lights according to claim 5 further comprising an electrical cord wrapped down the bar, the cord having light bulbs with sockets in which at least some sockets are held in place by the light socket support clips to simulate an icicle.

7. A frame for suspending ornamental lights according to claim 1 wherein the rod has a plurality of prongs along its length between the two ends for holding ornamental light cord and the bar has a plurality of light socket support clips spaced along its length.

8. A frame for suspending ornamental lights according to claim 1 further comprising at least one shingle-gutter member for attaching and suspending the frame from the hoop to a structure, the shingle-gutter member comprising a. a tongue having a proximal end and a distal end;

b. a spiral body having a curved portion on one side of the body to which the proximal end of the tongue is attached; and c. an extended projection on a side of the body opposite the tongue, the projection terminating in a hook from which the frame is suspended.

9. A frame for suspending ornamental lights according to claim 1 wherein the rod has a plurality of pegs spaced between the ends and at least three bars each having a different length and each bar being disposed pivotally on a separate peg, the rod also having a plurality of prongs and the bars each having a plurality of light socket support clips spaced along the lengths, the frame further comprising an electrical cord having light bulbs with sockets, wherein the electrical cord is wrapped along the rod and retained by the prongs and further wrapped along the lengths of the bars and wherein at least some of the light bulbs with sockets are held in place by the light socket support clips to simulate icicles.

10. A frame assembly for suspending ornamental lights comprising a plurality of flexible frames wherein each frame comprises a. a rod having an adjoining end and a hollow connecting end, the rod further comprising at least one hoop extending from the rod adapted to suspend the assembly from a structure and at least one peg projecting from the rod; and b. a bar disposed pivotally on the peg; wherein the adjoining end of one rod of one frame is disposed within the hollow connecting end of an adjacent rod of an adjacent frame to connect the frames together.

11. A frame assembly for suspending ornamental lights according to claim 9 wherein the frames have a plurality of pegs spaced between the ends of the rods and at least two bars having at least two different lengths, each bar disposed pivotally on a separate peg.

12. A frame assembly for suspending ornamental lights according to claim 10 wherein the frames have a plurality of pegs spaced between the ends of the rods and at least three bars having at least three different lengths, each bar disposed pivotally on a separate peg.

13. A frame assembly for suspending ornamental lights according to claim 10 wherein the rods have a plurality of spaced prongs for holding light cord.

14. A frame assembly for suspending ornamental lights according to claim 10 wherein the bars have a plurality of light socket support clips spaced along their lengths.

15. A frame assembly for suspending ornamental lights according to claim 14 further comprising an electrical cord wrapped along the rods and down the bars, the cord having light bulbs with sockets in which at least some sockets are held in place by the light socket support clips to simulate a plurality of icicles.

16. A frame assembly for suspending ornamental lights according to claim 10 wherein the rods have a plurality of prongs along their lengths for holding ornamental lights and the bars have a plurality of light socket support clips spaced along their lengths.

17. A frame assembly for suspending ornamental lights according to claim 10 further comprising a plurality of shingle-gutter members for attaching and suspending the assembly from the hoops to a structure, each shingle-gutter member comprising a. a tongue having a proximal end and a distal end;

b. a spiral body having a curved portion on one side of the body to which the proximal end of the tongue is attached; and c. an extended projection on a side of the body opposite the tongue, the projection terminating in a hook from which the assembly is suspended.

18. An assembly for suspending ornamental lights according to claim 9 wherein the rods have a plurality of pegs and at least three bars each having a different length and each bar being disposed pivotally on a separate peg, the rods also having a plurality of prongs and the bars each having a plurality of light socket support clips spaced along the lengths, the assembly further comprising an electrical cord having light bulbs with sockets, wherein the electrical cord is wrapped along the rods and retained by the prongs and further wrapped along the lengths of the bars and wherein at least some of the light bulbs with sockets are held in place by the light socket support clips to simulate icicles.

* * * * *